US007201408B2

(12) United States Patent
Cennamo, Jr.

(10) Patent No.: US 7,201,408 B2
(45) Date of Patent: Apr. 10, 2007

(54) SLIDABLE BOLT ASSEMBLY

(76) Inventor: Michael F. Cennamo, Jr., 140 Timber La., Eustis, FL (US) 32726

( * ) Notice: Subject to any disclaimer, the term of this patent is extended or adjusted under 35 U.S.C. 154(b) by 26 days.

(21) Appl. No.: 11/068,617

(22) Filed: Feb. 28, 2005

(65) Prior Publication Data

US 2006/0192394 A1 Aug. 31, 2006

(51) Int. Cl.
*E05C 1/06* (2006.01)
*E05C 1/02* (2006.01)

(52) U.S. Cl. ..... 292/143; 292/137; 292/150; 292/163; 292/332; 292/333; 292/334; 292/DIG. 21; 292/DIG. 44

(58) Field of Classification Search ..... 292/137, 292/3, 32, 34, 38, 40, 42, 92, 140, 143, 145, 292/150, 159, 162, 170, 171, 175, 332–334, 292/DIG. 15, DIG. 21, DIG. 44, DIG. 46, 292/139, 163
See application file for complete search history.

(56) References Cited

U.S. PATENT DOCUMENTS 135,396 A * 2/1873 Bishop ..... 292/143
176,598 A * 4/1876 Collins ..... 292/167
389,646 A * 9/1888 Gunniss ..... 292/143
480,148 A * 8/1892 Theby ..... 292/36
595,505 A * 12/1897 Wesling ..... 292/167
897,924 A * 9/1908 Prouty ..... 70/100
908,252 A * 12/1908 Hall ..... 292/173
1,005,849 A * 10/1911 Lange et al. ..... 292/61
1,015,424 A * 1/1912 Cline ..... 292/178
1,137,828 A * 5/1915 Anderson ..... 292/175
1,162,945 A * 12/1915 Ohnstrand ..... 292/138
1,225,285 A * 5/1917 Swaim ..... 292/175
1,270,740 A * 6/1918 Keyes ..... 292/40
1,335,235 A * 3/1920 Hildreth ..... 292/334
1,338,713 A * 5/1920 Toney ..... 292/335
1,492,088 A * 4/1924 Schmitz ..... 292/126
1,567,662 A * 12/1925 Mack ..... 292/34
1,670,430 A * 5/1928 Alexander ..... 292/143
2,815,975 A * 12/1957 Check et al. ..... 292/143
2,819,107 A 1/1958 Muessel
3,024,056 A * 3/1962 Cook ..... 292/177
3,183,027 A * 5/1965 Powers ..... 292/40
3,378,290 A 4/1968 Sekulich
3,556,573 A 1/1971 Miller (Continued)

*Primary Examiner*—Carlos Lugo
(74) *Attorney, Agent, or Firm*—The Livingston Firm; Edward M. Livingston; Angela M. Miller

(57) ABSTRACT

A slidable bolt assembly (4) having a tension spring (16) mounted to a slide bolt rod (5). The actuating lever (8) is adapted to be pivotally mounted and is hand-operated. The actuating lever (8) is attached to a leaf tension spring (16) at one end and securely fastened to a bolt rod (5) on the other. The bolt member (5) is projected and retracted within the door by pivotal action of the actuating lever (8). Because the slidable bolt assembly (4) is attachable to the front of a door, the assembly (4) may be used on either an active (2) or inactive (3) door. In addition, the decorative mounting plate (7) allows a user to tastefully protect his or her home or business from excessive force caused by winds, intruders or other undesirable elements and promotes safety by restricting unauthorized individuals from access into or out of a room.

13 Claims, 2 Drawing Sheets

U.S. PATENT DOCUMENTS

| | | | | |
|---|---|---|---|---|
| 3,680,901 | A | 8/1972 | Biebuyck | |
| 3,801,144 | A * | 4/1974 | Diehl | 292/92 |
| 4,005,886 | A * | 2/1977 | Lirette | 292/177 |
| 4,099,753 | A * | 7/1978 | Gwozdz et al. | 292/177 |
| 4,315,647 | A | 2/1982 | Wilzig et al. | |
| 5,004,277 | A * | 4/1991 | Campbell et al. | 292/166 |
| 5,350,207 | A | 9/1994 | Sanders | |
| 5,509,700 | A * | 4/1996 | Kennedy, Jr. | 292/3 |
| 5,590,919 | A | 1/1997 | Germano | |
| 6,666,486 | B1 | 12/2003 | Fleming | |
| 6,669,244 | B1 | 12/2003 | Bredthauer | |
| 6,883,837 | B1 * | 4/2005 | Lin | 292/33 |

* cited by examiner

SLIDABLE BOLT ASSEMBLY

BACKGROUND OF THE INVENTION

This invention relates to door bolt assemblies, more particularly, a slidable bolt assembly that safely maintains a door in a closed position under excessive force.

Bolt assemblies have been in use in homes and businesses for many years as they add a sense of security for the home or business owner. There are many types of bolt assemblies, ranging from assemblies that are used primarily on front and back doors for security measures (such as deadbolts) and assemblies that are used on windows to lock a window in a closed position to surface bolt assemblies that are commonly used on French doors to keep one-half of the pair of doors closed while the other half of the pair is opened or closed.

Although the use of these bolt assemblies do provide a locking means and an added measure of security, the assemblies are limited as to application. For instance, deadbolts are typically used on active doors. However, as they are typically mounted in a location adjacent to a door handle, the deadbolt does not provide a locking feature near the top of the door. Thus, under excessive force (such as high winds or a person breaking-in), the top of the door may flex, thereby compromising the weather striping seal and allowing water, or even worse, an intruder, an access of entry. Moreover, deadbolts are typically made of heavy metal and are unattractive. Thus, many homeowners and business owners do not utilize deadbolts as the deadbolts detract from the ambience of the home or business.

In the alternative, surface bolt assemblies are hidden as they are located on the side of an inactive door which is primarily positioned in a closed status. However, the use of surface bolt assemblies is burdensome as one must first open the active door to have access to the actuating lever in order to unlock the surface bolt.

Thus, a need exists for a decorative door bolt assembly that safely secures a door in a closed position under excessive force due to high winds and other conditions while allowing a user to easily access an actuating lever.

The relevant prior art includes the following patents:

| Pat. No. (U.S. unless stated otherwise) | Inventor | Issue/Publication Date |
|---|---|---|
| 4,315,647 | Wilzig et al. | Feb. 16, 1982 |
| 3,556,573 | Miller | Jan. 19, 1971 |
| 3,680,901 | Biebuyck | Aug. 01, 1972 |
| 2,819,107 | Muessel | Jan. 07, 1958 |
| 6,666,486 | Fleming | Dec. 23, 2003 |
| 5,350,207 | Sanders | Sep. 27, 1994 |
| 5,590,919 | Germano | Jan. 07, 1997 |
| 3,378,290 | Sekulich | Apr. 16, 1968 |
| 6,669,244 | Bredthauer | Dec. 30, 2003 |

SUMMARY OF THE INVENTION

The primary object of the present invention is to provide a slidable bolt assembly that securely retains a door in a closed position under excessive force.

A further object of the present invention is to provide a slidable bolt assembly that may be used on an may be used on an active door or an active leaf.

An even further object of the present invention is to provide a slidable bolt assembly that is decorative.

A further object of the present invention is to provide a slidable bolt assembly that may be used on in-swinging or out-swinging doors.

An even further object of the present invention is to provide a slidable bolt assembly that is easy to use.

An even further object of the present invention is to provide a slidable bolt assembly that has an easily accessible actuating lever.

Another object of the present invention is to provide a slidable bolt assembly that minimizes flexing of a door under excessive force.

An even further object of the present invention is to provide a slidable bolt assembly that provides a safety means to prevent children and others from an unauthorized entrance/exit of a doorway.

The present invention fulfills the above and other objects by providing a slidable bolt assembly comprised of an actuating lever connected to a tension spring mounted to a slide bolt rod. The actuating lever, tension spring and bolt rod are maintained in a housing assembly which is securable to a decorative mounting plate.

To use the present invention, a person mounts the slidable bolt assembly at a predetermined location on a face of the door, such as the top of the door, bottom of the door or a location near a doorknob. Then a person engages the bolt assembly by sliding an actuating lever in a downward direction or disengages the bolt assembly by sliding the actuating lever in an upward direction.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
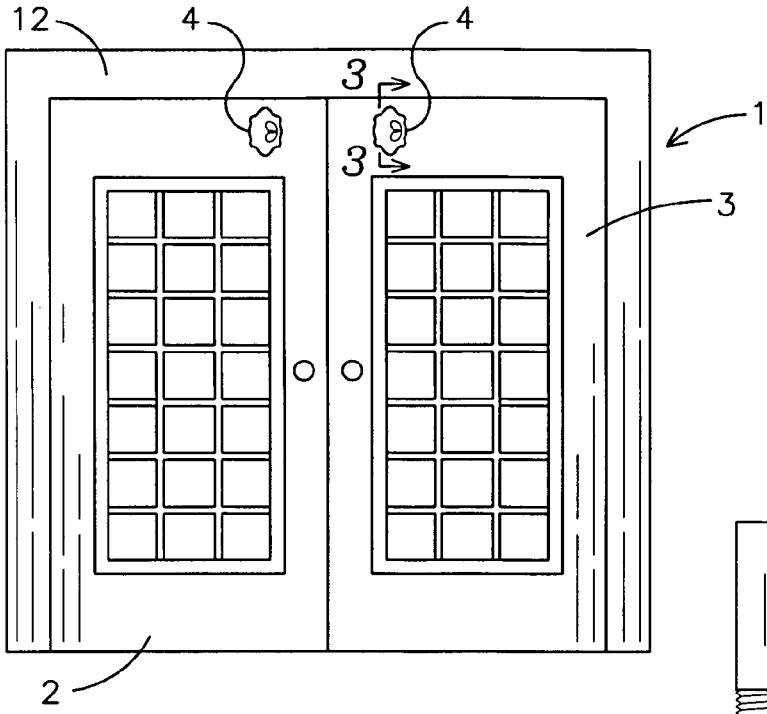
FIG. 1 is a front view of the slidable bolt assembly of the present invention installed on French doors.

For purposes of describing the preferred embodiment, the terminology used in reference to the numbered components in the drawings is as follows:

1. French doors
2. active door
3. inactive door
4. slidable bolt assembly, generally
5. bolt rod
6. cap
7. mounting plate
8. actuating lever
9. hole
10. fastening means
11. opening

12. door frame
13. front of door
14. lever guide
15. lever arm
16. tension spring
17. compression rivet
18. washer
19. housing assembly
20. spring/lever assembly
21. pivot pin
22. slot-type channel
23. end of lever
24. bolt extension sleeve
25. bolt extension rod
26. gripping portion With reference to FIG. 1, a front view of the slidable bolt assembly, generally 4 of present invention installed on French doors 1 is shown. The slidable bolt assembly, generally 4, may be placed on an active door 2 or an inactive door 3. The slidable bolt assembly, generally 4, may be placed on a door at a location near a top of the door as shown, near a bottom of the door or at a location adjacent to a doorknob so as to be securable to a door frame 12. Although the slidable bolt assembly, generally 4 of present invention is shown installed on French doors 1, the slidable bolt assembly, generally 4 may also be used on a single active door.

Figure 2:
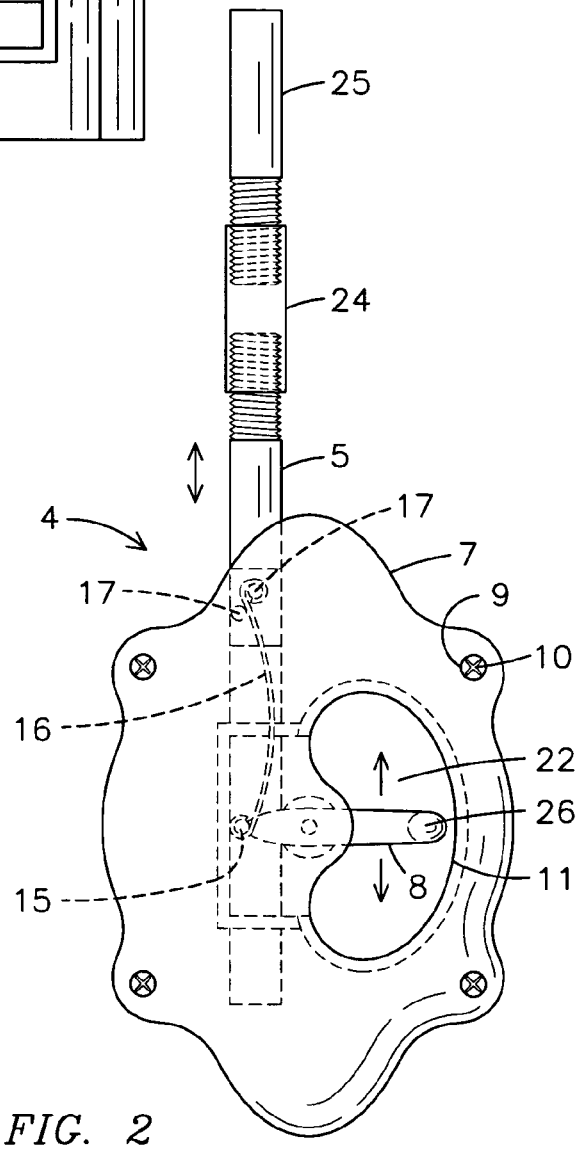
FIG. 2 is a plan view of the slidable bolt assembly by itself.

In FIG. 2, a plan view of the slidable bolt assembly, generally 4 by itself is shown. The slidable bolt assembly, generally 4, includes a mounting plate 7 and a slidable bolt rod 5 made of a rigid and strong material, such as steel. The mounting plate 7 has at least one opening 9 for the acceptance of a fastening means 10, which may be screws, and an opening 11. The slidable bolt 5 may be threaded on one end for the receipt of an optional bolt extension sleeve 24 and a bolt extension rod 25. The bolt extension sleeve 24 and bolt extension rod 25 allow the slidable bolt assembly, generally 4 to be used at any location on a door 2 or 3, regardless of the distance to a door frame 12. In addition, the use of the bolt extension rod 25 allows for the accommodation of both standard door heights and door heights in excess of standard. For example, the bolt extension rod 25 would permit the securing of a 10 foot active door to a door frame, thereby virtually eliminating door flexing during high wind conditions which flex the edge of doors to the extent that the weather seal is compromised and the occurrence of water intrusion. However, the bolt rod 5 need not be threaded in order to attach a bolt extension sleeve 24 or bolt extension rod 25 to the bolt rod 5. A tension spring 16 is attached on one end to a lever arm 15 of an actuating lever 8 and on another end to a compression rivet 17 on the bolt rod 5. In order to use the device, a user simply moves the actuating lever 8 located between the mounting plate opening 11 and a slot-type channel 22 by grasping a gripping portion 26 and moving the gripping portion 26 in an upward or downward motion to disengage or engage the bolt rod 5, respectively, within a door frame 12, thereby preventing opening of the door 2 or 3. Thus, the bolt rod 5 moves in an upward and downward motion relative to the door 2 or 3 depending on whether the actuating lever 8 is engaged or disengaged, respectively. Because the actuating lever 8 is housed within the housing assembly 19, the actuating lever 8 moves in a parallel direction to the front of the door 13, rather than in an out-swinging, perpendicular motion in relation to the front of the door as is typical in most slidable bolt assemblies.

Figure 3:
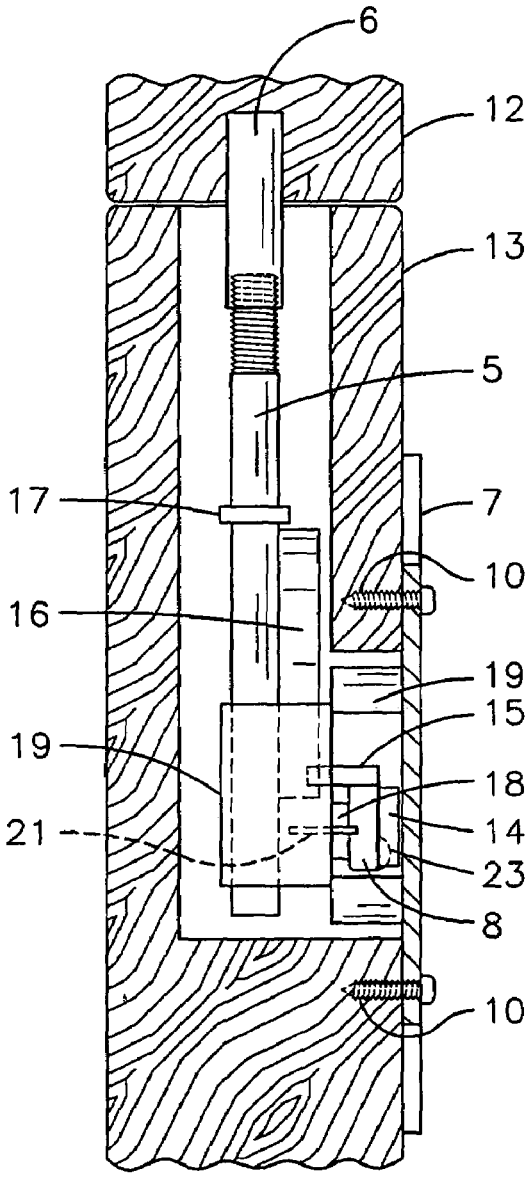
FIG. 3 is a cross-sectional view along line 3—3 of the embodiment of FIG. 1.

FIG. 3 shows a cross-sectional view along line 3—3 of the embodiment of FIG. 1 wherein the slidable bolt assembly, generally 4 is in use. The bolt rod 5 may include a cap 6, which is threaded internally, so as to be securable to the bolt rod 5, bolt extension sleeve 24 or bolt extension rod 25. The use of the cap 6 minimizes damage to the door frame 12 and door 2 or 3 due to the threading of the bolt rod 5, bolt extension sleeve 24 or bolt extension rod 25. With the exception of the mounting plate 7 which is mounted to the front 13 of a door 3 via fastening means 10, the slidable bolt assembly, generally 4 is housed within a door or, when in use, within a door and partially within a door frame 12. Secured to the back of the mounting plate 7 is a lever guide 14 which helps to maintain the correct positioning and movement of the actuating lever 8. A washer 18 is located behind the actuating lever 8 to keep the actuating lever 8 at a predetermined distance from a housing assembly 19 and to reduce the friction between the actuating lever 8 and the housing assembly 19 and to provide for a smooth, effortless operation of engaging and disengaging of the bolt rod 5 within a door frame 12, thereby preventing opening of the door 3. A pivot pin 21 secures the actuating lever 8 and washer 18 to the housing assembly 19 and acts as a pivot point for the actuating lever 8 and permits the actuating lever 8 to swing vertically through a 90 degree rotation. The actuating lever 8 has a lever arm 15 wherein a tension spring 16 is securable thereto. The tension spring 16 is connected directly to the bolt rod 5 via a compression rivet 17. The actuating lever 8 may have an enlarged, semicircular end 23 to allow a person to easily grasp the actuating lever 8.

Figure 4:
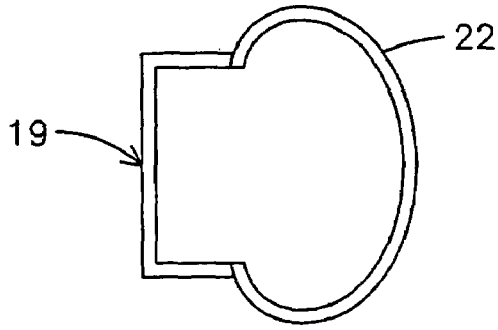
FIG. 4 is a front view of the housing of the present invention.

FIG. 4 shows a front view of the housing assembly 19 of the present invention. The housing assembly 19 includes a slot-type channel 22 for the accommodation of the actuating lever 8. The housing assembly 19 is made of a rigid and strong material, such as steel, so as to withstand excessive force caused by high winds due to hurricanes.

Figure 5:
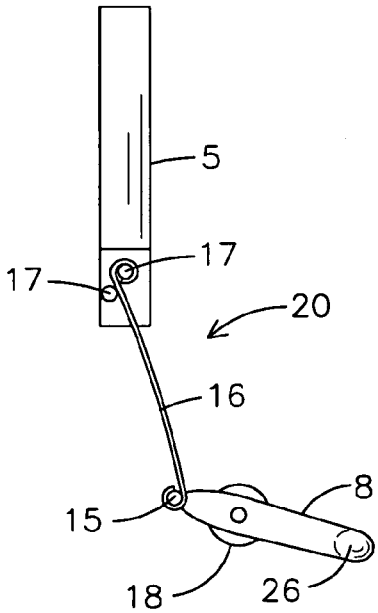
FIG. 5 is a front view of the spring/lever assembly of the present invention.

Finally, FIG. 5 shows a front view of the spring/lever assembly 20 of the present invention. The spring/lever assembly 20 allows for the movement of the bolt rod 5 via the actuating lever 8 by having the lever arm 15 receiving an end of a leaf-type tension spring 16 while the another end of the leaf-type tension spring 16 is securely mounted to the bolt rod 5 via a compression rivet 17. The tension spring 16 remains in tension at all times, although tension is reduced when the bolt rod 5 is engaged or disengaged. The reduced tension tends to force the lever to either the engaged or disengaged position and keeps the bolt rod 5 in place. The tension is provided to hold the bolt rod 5 against the back and side of the housing assembly 19.

Because the actuating lever 8 rests in a slot-type channel 22 within the housing assembly 19 and the mounting plate 7 is secured to the front or back of a door, rather than on a side of a door as in most French doors having bolt assemblies, a person may engage or disengage the slidable bolt assembly 4 without having to open inactive doors.

The use of the present invention will allow a person to safely and decoratively maintain a door in a closed position even under excessive force. Moreover, the use of the present invention will allow a person to prevent unauthorized access through a doorway, such as to prevent children from entering a swimming pool area or preventing intruders from entering one's home.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. A slidable bolt assembly comprising:

a mounting plate attached to a housing assembly;

said mounting plate having a means for fastening to an outer surface of a door;

said mounting plate having an opening;

an actuating lever pivotally mounted in said housing assembly to rotate parallel to said outer surface of a door;

said actuating lever including a grip portion at a first end and a lever arm at a second end opposed said first end;

a bolt rod operably connected to said actuating lever via a tension spring;

said bolt rod includes at least one rivet;

said tension spring having one end directly connected to said lever arm of said actuating lever and having an opposed end directly connected to one of said at least one rivet of said bolt rod; and said bolt rod is operable in an upward and downward motion relative to said door by moving said actuating lever.

2. The slidable bolt assembly of claim 1 wherein:

said means for fastening is screws.

3. The slidable bolt assembly of claim 1 wherein:

said bolt rod is threaded.

4. The slidable bolt assembly of claim 3 wherein:

a cap is securable to said threaded bolt rod.

5. The slidable bolt assembly of claim 3 wherein:

a bolt extension sleeve is securable to said threaded bolt rod; and a bolt extension rod is connected to said bolt extension sleeve so said bolt extension rod enables the assembly to be placed on a door further from a door frame.

6. The slidable bolt assembly of claim 1 wherein:

said bolt rod is threaded.

7. The slidable bolt assembly of claim 6 wherein:

a cap is securable to said threaded bolt rod.

8. The slidable bolt assembly of claim 6 wherein:

a bolt extension sleeve is securable to said threaded bolt rod; and a bolt extension rod is connected to said bolt extension sleeve so said bolt extension rod enables the assembly to be placed on a door further from a door frame.

9. The slidable bolt assembly of claim 1 further comprising:

a lever guide on said mounting plate.

10. The slidable bolt assembly of claim 1 wherein:

said actuating lever has an enlarged end.

11. The slidable bolt assembly of claim 1 wherein:

a bolt extension rod is securable to said bolt rod.

12. A slidable bolt assembly comprising:

a mounting plate attached to a housing assembly;

said mounting plate having a means for fastening to an outer surface of a door;

said means for fastening is via screws;

said mounting plate having an opening;

said mounting plate having a lever guide;

an actuating lever pivotally mounted in said housing assembly to rotate parallel to said outer surface of a door;

said actuating lever including a grip portion at a first end and a lever arm at a second end opposed said first end;

said actuating lever having an enlarged end;

a bolt rod operably connected to said actuating lever via a tension spring;

said bolt rod includes at least one rivet;

said tension spring having one end directly connected to said lever arm of said actuating lever and having an opposed end directly connected to one of said at least one rivet of said bolt rod; and said bolt rod is operable in an upward and downward motion relative to said door by moving said actuating lever;

said bolt rod is threaded; and a bolt extension rod is attachable to said bolt rod by a bolt extension sleeve.

13. A method of using a slidable bolt assembly, comprising a mounting plate attached to a housing assembly; said mounting plate having a means for fastening to an outer surface of a door; said mounting plate having an opening; an actuating lever pivotally mounted in said housing assembly to rotate parallel to said outer surface of a door; said actuating lever including a grip portion at a first end and a lever arm at a second end opposed said first end; a bolt rod operably connected to said actuating lever via a tension spring; said bolt rod includes at least one rivet; said tension spring having one end directly connected to said lever arm of said actuating lever and having an opposed end directly connected to one of said at least one rivet of said bolt rod; and said bolt rod, and said bolt rod is operable in an upward and downward motion relative to said door by moving said actuating lever, said method comprising the steps of:

a. closing said door to be bolted;

b. positioning said actuating lever in a downward position to engage said bolt rod within a door frame;

c. positioning said actuating lever in an upward position to disengage said bolt rod within a door frame; and d. opening said door.

* * * * *